US006817603B2

(12) United States Patent
Kofod

(10) Patent No.: US 6,817,603 B2
(45) Date of Patent: Nov. 16, 2004

(54) CLAMPING TOOL

(75) Inventor: Bent Karsten Kofod, Kalundborg (DK)

(73) Assignee: Danpres A/S, Låsby (DE)

( * ) Notice: Subject to any disclaimer, the term of this patent is extended or adjusted under 35 U.S.C. 154(b) by 0 days.

(21) Appl. No.: 09/930,239

(22) Filed: Aug. 16, 2001

(65) Prior Publication Data

US 2002/0020953 A1 Feb. 21, 2002

Related U.S. Application Data

(63) Continuation of application No. PCT/DK00/00064, filed on Feb. 17, 2000.

(30) Foreign Application Priority Data

Feb. 17, 1999 (DK) ..... 1999 00206

(51) Int. Cl.[7] ..... B25B 1/14
(52) U.S. Cl. ..... 269/228; 269/201
(58) Field of Search ..... 269/228, 237, 269/201, 236, 238

(56) References Cited

U.S. PATENT DOCUMENTS

| | | | | |
|---|---|---|---|---|
| 1,997,428 A | * | 4/1935 | Olson | 269/228 |
| 3,480,271 A | | 11/1969 | Coutilish | 269/228 |
| 3,831,926 A | * | 8/1974 | Sendoykas et al. | 269/228 |
| 3,924,844 A | * | 12/1975 | Bachtel, Jr. | 269/228 |
| 4,141,543 A | | 2/1979 | Kato | 269/228 |
| 4,407,493 A | | 10/1983 | Okolischan | 269/93 |
| 5,516,088 A | | 5/1996 | Coffin, III | 269/166 |
| 5,527,024 A | * | 6/1996 | Dykstra | 269/228 |
| 5,921,535 A | * | 7/1999 | Lutz, III | 269/228 |
| 5,961,109 A | * | 10/1999 | Dykstra et al. | 269/228 |
| 6,116,588 A | * | 9/2000 | Yamane | 269/228 |

FOREIGN PATENT DOCUMENTS

| | | |
|---|---|---|
| CH | 682379 A5 | 9/1993 |
| DE | 2519926 A1 | 11/1976 |
| FR | 2601609 A1 | 1/1988 |
| WO | WO 79/01157 | 12/1979 |

OTHER PUBLICATIONS

PCT International Search Report for PCT/DK 00/00064 filed Feb. 17, 2000; dated May 23, 2000.
Danish Search Report for PA 1999 00206 dated Dec. 10, 1999.

* cited by examiner

*Primary Examiner*—Lee D. Wilson
(74) *Attorney, Agent, or Firm*—Winston & Strawn LLP

(57) ABSTRACT

A clamping tool serving for clamping a workpiece on a support by a bar system constructed of a number of mutually pivotal bars comprising an activation bar for at operation making the bars pivot mutually between an initial position and locking position, a clamping bar having at least one clamp shoe for pressing against the workpiece in the locking position of the bar system, and a base for mounting the bar system on the support. The bar system furthermore comprises two toggle joints arranged to simultaneously or almost simultaneously assume their dead point positions when the bar system at activation is taken from the initial position to the locking position. In the dead point positions the two toggle joints form an angle with each other. Thereby the clamping tool according to the invention is rendered capable of simultaneously acting on a workpiece which is to be clamped on a support with compressive forces in at least two directions so that the number of the clamping tools required for a given task can be reduced by one half compared to the number that is required when conventional clamping tools are used.

22 Claims, 2 Drawing Sheets

CLAMPING TOOL

CROSS-REFERENCE TO RELATED APPLICATIONS

The present application is a continuation of the U.S. National Stage designation of co-pending International Patent Application PCT/DK00/00064, filed Feb. 17, 2000. The entire contents of which is expressly incorporated herein by reference thereto.

BACKGROUND OF THE INVENTION

The invention relates to a clamping tool for clamping a workpiece to a support by means of a bar system constructed of a number of mutually pivotal bars and comprising an activation bar for at operation making the bars pivot mutually between an initial position and a locking position, a clamping bar having at least one thrust shoe for pressing against the workpiece in the locking position of the bar system, and a base for mounting the bar system on the support.

Several different designs for such clamping tools are known that however have that in common that they are only able to exert pressure to a workpiece in one specific direction. Such a design is e.g. known from FR 260 1609. This invention relates to a system for immobilising a component located on the work table of machine tools.

In many cases, it is however necessary to clamp the workpiece in two directions, e.g. both a vertical and a horizontal. This is e.g. the case when a number of workpieces are to be welded together to a whole in a welding fixture, and each workpiece for this purpose must be positioned in two direction in order to obtain the accuracy that normally is required of such welded objects. Instead of one set of clamping tools, two sets have to be used, namely one set for clamping the workpieces in one direction and a second set for clamping the workpieces in a second direction.

The operation of the many clamping tools is labour-consuming and increases thereby the production costs. The doubling of the number of clamping tools furthermore means that the welding fixtures are expensive to produce.

SUMMARY OF THE INVENTION

The object of the invention is to eliminate the above disadvantages of the known clamping tools by providing a clamping tool of the kind mentioned in the opening paragraph that is arranged in such a way that it is able to simultaneously act on a workpiece which is to be clamped to a support with compressive forces in at least two directions.

The novel and unique features according to the invention, whereby this is achieved, is the fact that the bar system comprises at least two toggle joints, that at lest two of these toggle joints are arranged to simultaneously or almost simultaneously assume their dead point positions when the bar system at activation is taken from the initial position to the locking position, and that said two toggle joints form an angle with each other in the dead point position.

By means of this arrangement of the clamping tool, a thrust shoe on the clamping bar can be made to act on a workpiece with a pressure in one direction while a second thrust shoe on the clamping bar simultaneously can act on the same workpiece with a pressure in a second direction.

A number of workpieces, which e.g. are to be welded together to form a whole in a welding fixture, can now be clamped securely and precisely in the fixture by means of normally half as many clamping tools as is required when conventional clamping tools are used. Thereby the task of clamping the workpieces and subsequently removing the finished, welded object from the fixture is facilitated and made less expensive, just as the costs for producing the fixture are reduced considerably.

The two joints of each toggle joint can according to the invention together form an angle which in the initial position of the bar system is pointing the point in the opposite direction of the thrust shoe, and the bar system can furthermore be arranged in such a way that its two toggle joints are put into their dead point positions by taking the bar system from the initial position towards the locking position. When the toggle joints during this approach the dead point positions, it will using a moderate manual force application on the handle of the bar system be possible to act on the workpiece that is to be clamped with considerable compressive forces in two direction at the same time. The maximum effect on the workpiece is obtained in the dead point positions in which the position of the whole bar system however is labile.

In the locking position of the bar system, each toggle joint is therefore taken beyond the dead point to a position in which its two joints together form an angle the point of which is pointing towards the thrust shoe. To maintain the great force application on the workpiece that is to be clamped, said angle is only a little smaller than 180°, e.g. 1°–2° smaller.

In an especially expedient and effective embodiment, the bar system according to the invention can comprise a first swivel connection for pivotally journaling one end of the activation bar in the base while the other end of the activation bar is free and serves as handle of the clamping tool; a rocking bar which at one end is pivotally journaled in the base via a second swivel connection which is nearer the at least one thrust shoe than the first swivel connection, and at the other end is pivotally journaled in the clamping bar via a third swivel connection; a first toggle joint having a first joint which at one end is pivotally journaled in the clamping bar via a fourth swivel connection which is farther from the at least one thrust shoe than the third swivel connection, and at the other end is pivotally journaled in the activation bar via a fifth swivel connection, and a second joint consisting of the part of the activation bar that is extending from the fifth to the first swivel connection; and a second toggle joint having a first joint which at one end is pivotally journaled in the rocking bar and/or clamping bar via a sixth swivel connection and at the other end is pivotally journaled in the activation bar via a seventh swivel connection which in the locking position of the clamping tool is nearer the at least one thrust shoe than the first and fifth swivel connection, and a second joint consisting of the part of the activation bar that is extending between the seventh and first swivel connection.

In one embodiment, the first joint of the second toggle joint can be pivotally connected to the clamping bar with the same swivel connection as the rocking bar while the first joint of the second toggle joint in a second embodiment can be pivotally connected to the rocking bar via a swivel connection another place on the bar. The first and second toggle joint can pass the dead point positions simultaneously when the bar system is taken from its initial position to its locking position. Thereby, the workpiece to be clamped is affected simultaneously in the two different pressure directions of the clamping tool. If the two toggle joints do not get to pass the dead points simultaneously, the workpiece can be clamped in one direction before it is finally clamped in a second direction. One of or each of the first joints of the two toggle joints can be shaped as a U with a bottom and two sides so that the bar system can be constructed compactly together.

BRIEF DESCRIPTION OF THE DRAWINGS

The invention will be explained in greater detail below, describing only exemplary embodiments with reference to the drawing, in which.

DETAILED DESCRIPTION OF THE PREFERRED EMBODIMENTS

Figure 1:
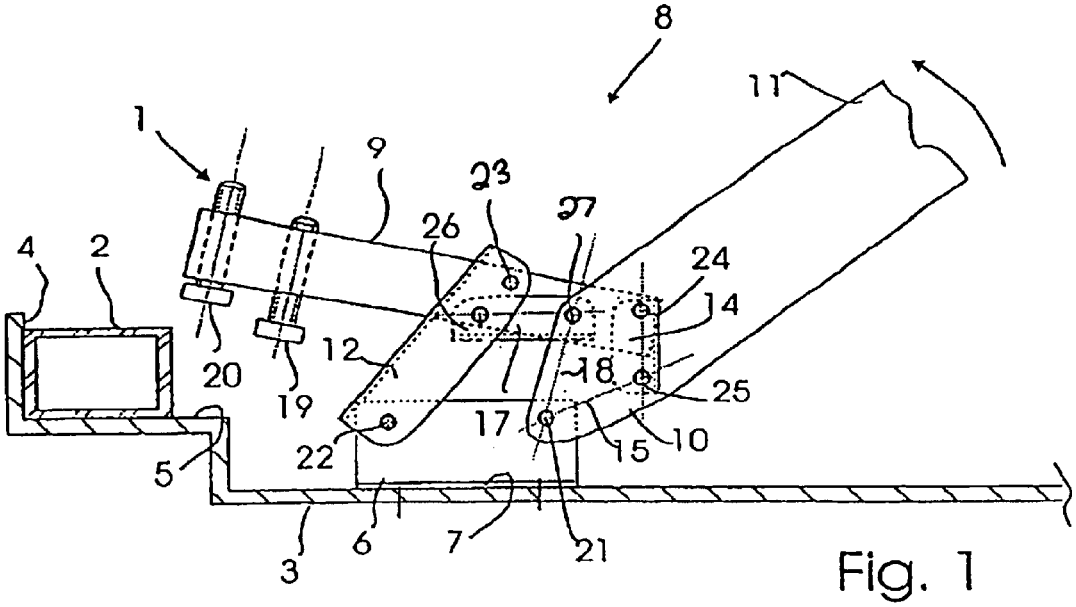
FIG. 1 is a side elevational view of a clamping tool according to the invention in an initial position.

Swivel connections will in the following for exemplary illustration be called swivel pins.

In the following it is assumed as an exemplary description of the invention that the clamping tool generally designated by the reference numeral 1 is to serve for clamping a workpiece 2 in a welding fixture 3 having a vertical contact face 4 and horizontal contact face 5.

The clamping tool comprises a base 6 with flaps 7 for mounting the base on the welding fixture by means of e.g. screws or welding (not shown). The clamping tool furthermore comprises a bar system 8 which is pivotally connected to the base. The bar system consists of a clamping bar 9, an activation bar 10 having a handle 11, a rocking bar 12, a first toggle joint 13 having a first joint 14 and a second joint 15, and a second toggle joint 16 having a first joint 17 and a second joint 18.

On the end of the clamping bar 9 opposite the activation bar 10 is mounted a clamp shoe 19 in the following called push shoe 19, and a clamp shoe 20 in the following called thrust shoe 20. Both clamp shoes are in the shown case shaped as screws that can be screwed on and adjusted in the clamping bar 9 by means of a not-shown screw connection.

As shown, the activation bar 10 is extending upwardly from the base 6 and is pivotally connected to this via swivel pins 21. The rocking bar 12 is also extending upwardly from the base and is pivotally connected to this via swivel pins 22 that are nearer the clamp shoes 19;20 than the swivel pins 21. At the other end the rocking bar is pivotally connected to the clamping bar via a swivel pin 23.

The first joint 14 of the first toggle joint 13 is at a larger distance from the clamp shoes 19;20 than the swivel pin 23 connected to the clamping bar 9 via a swivel pin 24. At the other end the first joint 14 of the first toggle joint 13 is pivotally connected to the activation bar 10 via swivel pins 25. The part of the activation bar that is between the swivel pins 25 and 21 forms the second joint 15 of the first toggle joint 13.

The first joint 17 of the second toggle joint 16 is at some point between the swivel pins 22 and 23 pivotally connected to the rocking bar 12 via swivel pins 26. At the other end the first joint 17 of the second toggle joint 16 is pivotally connected to the activation bar 10 via swivel pins 27. The part of the activation bar that is between the swivel pins 27 and 21 forms the second joint 18 of the second toggle joint 16.

In FIG. 1 the bar system of the clamping tool is in the initial position with the clamp shoes 19;20 at a distance from the workpiece 2 which is to be clamped to the vertical and horizontal contact faces 4;5 of the welding fixture 3. The two joints 14 and 15 of the first toggle joint 13 together form, as shown, an angle with the peak point 25 pointing to the right in the figure, that is in the opposite direction of the clamp shoes 19 and 20. Also the two joints 17 and 18 of the second toggle joint 16 together form an angle with the peak point 27 pointing to the right in the figure.

Figure 2:
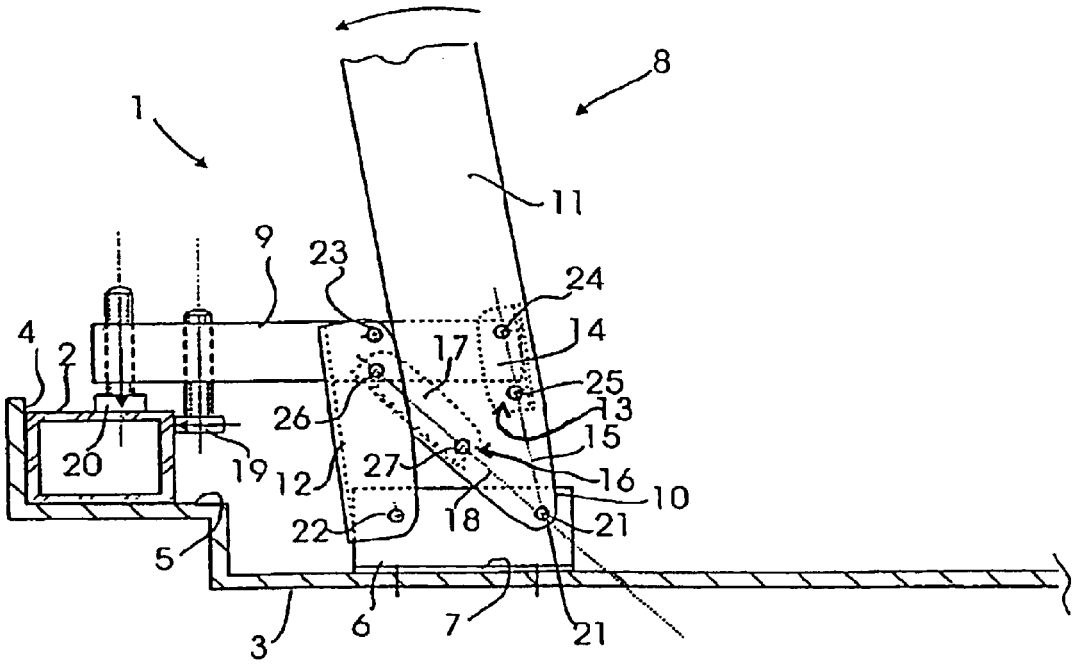
FIG. 2 shows the clamping tool in FIG. 1 in a locking position.

By manually taking the handle 11 of the activation bar 10 in the direction of the arrow, the bars 9, 10, 12, 14 and 17 of the bar system 8 pivot about their respective swivel pins 21, 22, 23, 24, 25, 26 and 27 from the initial position in FIG. 1 to the locking position in FIG. 2. During this operation the rocking bar 12 pivots about its lower swivel pins 22 on the base 6 whereby the upper swivel pin 23 of the bar on the clamping bar 9 is made to describe an arch. At the same time the rearmost end of the clamping bar 9 is lifted up of the first toggle joint 13 which is straightened out. This combined motion means that the clamp shoes 19 and 20 are moving in an arch in over the workpiece 4. At the same time the second toggle joint 16 is also straightened out. Finally the push shoe 19 pushes the workpiece 2 in towards the vertical contact face 4 of the welding fixture 3 while the thrust shoe 20 presses the workpiece 2 down towards the horizontal contact face 5 of the welding fixture 3.

The bar system is arranged so that the two toggle joints 13 and 16 just passes their dead point positions in this final position. Thereby the bar system is locked as back pressures of the workpiece are not able to pivot the toggle joints back to their initial positions once they have passed the dead point positions.

In order for the clamp shoes 19 and 20 effectively to be able to clamp the workpiece 2 against the support 3, the considerable compressive forces that can be obtained in the dead point positions of the toggle joints must not be weakened very much when the toggle joints pass into the dead points, and the two joints 14;15 and 17;18 respectively of each toggle joint 13;16 together form an angle that points its point in the direction towards the clamp shoes 19;20. This angle is therefore chosen to be between 175° and 180°, preferably between 177° and 180°, and especially between 178° and 180°.

As shown, the two toggle joints form in straightened position an angle in relation to each other. Thereby the bar system can absorb reaction forces in two directions. The vertical reaction force on the thrust shoe 20 is mainly transmitted via the first toggle joint 13 to the swivel pins 21 on the base 6 while the horizontal reaction force on the push shoe 19 is mainly transmitted via the second toggle joint 16 to the same swivel pin 21 on the base 6.

As it can be seen the clamping tool according to the invention can contrary to the conventional clamping tools thus clamp a workpiece securely and precisely in e.g. a welding fixture with forces that have effect in two different directions. The number of clamping tools can thereby be reduced by one half. Thereby considerable advantages are gained in that the task is facilitated and that the welding fixtures will be less expensive.

In the shown bar system the bars are constructed closely together. In order to under these conditions be able to give the bars the necessary strength and stability, the rocking bar 12 and the respective first joints 14 and 17 of the two toggle joints are each shaped as a U that allows for the placing and the mutual motion of the bars of the bar system.

Figure 3:
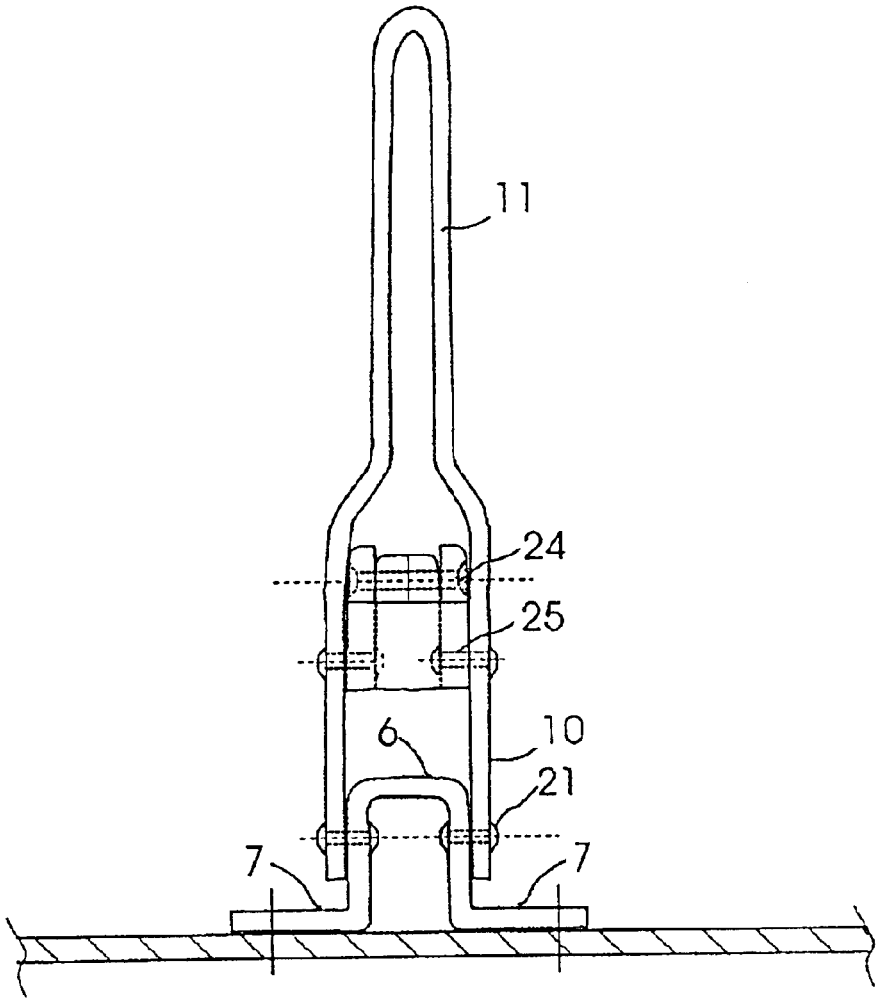
FIG. 3 is a back view of the clamping tool in FIGS. 1 and 2.

FIG. 3 shows that the activation bar 10 of the bar system is constructed as a fork which in order to form a good handle is more narrow at the top. It is furthermore shown that the base 6 is shaped as an inverted U with two fastening flaps 7 extending out to each their side from the U.

Figure 4:
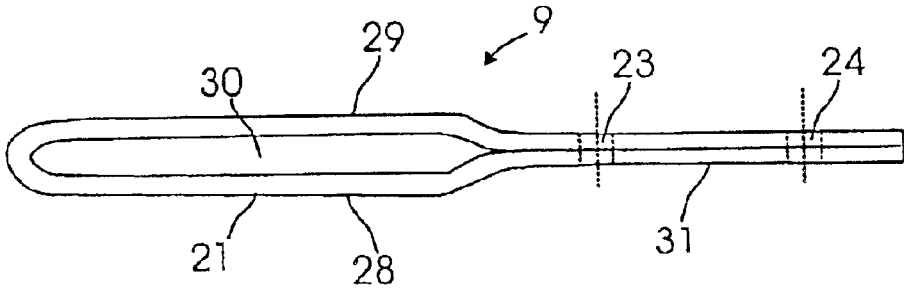
FIG. 4 is a plan view of a clamping bar of the clamping tool.

The clamping bar 9 consists in the case shown in FIG. 4 of a bent flat bar having two legs 28 and 29 that at the end near the clamp shoe leave a gap 30 between them for taking up the clamp shoes while the legs at the other end are placed close together and thereby forming a shank 31 for fitting in between the rest of the bars. In the shank are holes for the swivel pins 23 and 24.

In one exemplary embodiment, the bar system 8 includes a first swivel connection 21 for pivotally journaling one end of the activation bar 10 in the base 6 while the other end of the activation bar 10 is free and serves as handle 11 of the clamping tool. A rocking bar 12 is pivotally journaled in the base 6 via a second swivel connection 22 which is nearer to the clamp shoes 19, 20, than the first swivel connection 21. The other end of the rocking bar 12 is pivotally journaled in the clamping bar 9 via a third swivel connection 23. A first toggle joint 13 has a first joint 14 which is pivotally journaled in the clamping bar 9 via a fourth swivel connection 24, located farther from the clamp shoes 19, 20 than the third swivel connection 23. The other end of the first joint 14 is pivotally journaled in the activation bar 10 via a fifth swivel connection 25. The first toggle joint 13 also has a second joint 15 consisting of the part of the activation bar 10 that is extending from the fifth swivel connection 25 to the first swivel connection 21. A second toggle joint 16 has a first joint 17 which at one end is pivotally journaled in the rocking bar 12 and/or clamping bar 9 via a sixth swivel connection 26, and at the other end is pivotally journaled in the activation bar 10 via a seventh swivel connection 27. When the clamping tool is in the locking position, the seventh swivel connection 27 is nearer the clamp shoes 19, 20 than the first swivel connection 21 and the fifth swivel connection 25. The second toggle joint also includes a second joint 17 consisting of the part of the activation bar 10 that is extending between the seventh swivel connection 27 and first swivel connection 21.

What is claimed is:

1. A clamping tool for clamping a workpiece by means of a bar system constructed of a number of mutually pivotal bars and comprising an activation bar for making the bars pivot mutually between an initial position and a locking position, a clamping bar having at least two clamp shoes for pressing against the workpiece in the locking position, and a base for mounting the bar system on the support, wherein the bar system furthermore comprises at least two toggle joints each toggle joint comprising two joints pivotally connected to one another, said two toggle joints arranged to substantially simultaneously assume a dead point position when the bar system is taken from the initial position to the locking position, and further wherein said two toggle joints form an angle with each other in the dead point positions.

2. The clamping tool according to claim 1, wherein the two joints of each toggle joint together form an angle than points its point in the opposite direction of the at least one clamp shoe in the initial position of the bar system.

3. The clamping tool according to claim 1, wherein the two joints and respectively of each toggle joint together form an angle that point its point in a direction towards the at least two clamp shoes in the locking position of the bar system.

4. The clamping tool according to claim 3, wherein the angle that the two joints of each toggle joint form together in the locking position of the bar system is between about 175° and about 180°.

5. The clamping tool according to claim 1, wherein the bar system comprises:

a first swivel connection for pivotally journaling a first end of the activation bar in the base while a second end of the activation bar is free and serves as handle for the clamping tool;

a rocking bar which at a first end is pivotally journaled in the base via a second swivel connection which is nearer the at least two clamp shoes than the first swivel connection and at a second end is pivotally journaled in the clamping bar via a third swivel connection;

a first toggle joint having a first joint which at a first end is pivotally journaled in the clamping bar via at fourth swivel connection which is farther from the at least two clamp shoes than the third swivel connection, and at a second end is pivotally journaled in the activation bar via a fifth swivel connection, and a second joint consisting of the part of the activation bar that is extending from the fifth to the first swivel connection; and a second toggle joint having a first joint which at a first end is pivotally journaled in one of the group consisting of the rocking bar and the clamping bar via a sixth swivel connection, and at a second end is pivotally journaled in the activation bar via a seventh swivel connection which an the locking position of the clamping tool is nearer the at least two clamp shoes than the first and the fifth swivel connection, and a second joint consisting of the part of the activation bar that is extending between the seventh and the first swivel connection.

6. The clamping tool according to claim 5, wherein the third and the sixth swivel connection coincide.

7. The clamping tool according to claim 5, wherein the sixth swivel connection is placed on the rocking bar between the second and the third swivel connection.

8. The clamping tool according to claim 1, wherein the first and the second toggle joint pass the dead point positions simultaneously when the bar system is taken from its initial position to its locking position.

9. The clamping tool according to claim 1, wherein the first joint of the first and second toggle joint respectively is shaped as a U having a bottom and two sides.

10. A clamping tool comprising:

a base member;

a bar system mounted to the base member and comprising a plurality of mutually pivotal bars including:

an activation bar pivotally mounted to the base member and being provided with a handle member;

a rocking bar also pivotally mounted to the base member and operatively connected to the activation bar via a first toggle joint, a clamping bar operatively connected to the activation bar via a second toggle joint and being pivotally mounted to said rocking bar, the clamping bar including at least two clamp shoes;

wherein the first toggle joint comprises a first joint pivotally connected to a second joint, and the second toggle joint comprises a first joint pivotally connected to a second joint;

further wherein the first and second toggle joints substantially simultaneously assume respective dead point positions, when the bar system is moved from a first, unlock position to a second, locked position, and the first and second toggle joints form an angle with respect to one another when in the dead point positions.

11. The clamping tool according to claim 10, further comprising first and second clamping surfaces formed on the clamp shoes, said first and second clamping surfaces being directed substantially perpendicular to one another.

12. The clamping tool according to claim 11, wherein the clamp shoes comprise first and second screws engaged to said clamping member wherein said first clamping surface is formed on said first screw and said second clamping surface is formed on said second screw.

13. A clamping tool comprising:

a base member;

a bar system including a plurality of mutually pivotal bars mounted to the base member, including:

an activation bar pivotally mounted to the base member;

a rocking bar pivotally mounted to the base member and operatively connected to the activation bar via a first toggle joint, a clamping member operatively connected to the activation bar via a second toggle joint and pivotally mounted to the rocking bar, the clamping member including at least two clamp shoes;

wherein the first and second toggle joints do not pass their respective dead point positions simultaneously when the bar system is moved from a first, unlocked position to a second, locked position;

further wherein the clamping member exerts a first clamping force and a second clamping force when the first and second toggle joints assume their respective dead point positions and the first clamping force is applied at an angle to the second clamping force.

14. The clamping tool of claim 13, wherein the first clamping force is substantially transverse to the second clamping force.

15. The clamping tool of claim 13, further comprising first and second clamping surfaces formed on the clamp shoes, said first clamping surface being oriented substantially perpendicular to said second clamping surface.

16. The clamping tool of claim 13, wherein the first and second toggle joints each comprise two joints that together form an angle having a vertex that points away from the clamping member when the bar system is in the initial position.

17. The clamping tool of claim 13, wherein the first and second toggle joints each comprise two joints that together form an angle having a vertex that points toward the clamping member when the bar system is in the locked position.

18. The clamping tool of claim 17, wherein the angle is between about 175° and about 180° when the bar system is in the locked position.

19. The clamping tool of claim 13, wherein the bar system comprises:

a first swivel connection for pivotally connecting a first end of the activation bar to the base;

second swivel connection for pivotally connecting a first end of the rocking bar to the base, the second swivel connection located nearer to the clamping member than the first swivel connection;

a third swivel connection for pivotally connecting a second end of the rocking bar to the clamping bar;

wherein the first toggle joint includes:

a first joint having a first end pivotally connected to the clamping bar via a fourth swivel connection, the fourth swivel connection located farther from the clamp member than the third swivel connection, and a second end pivotally connected to the activation bar via a fifth swivel connection; and a second joint comprising the portion of the activation bar that extends from the fifth swivel connection to the first swivel connection;

further wherein the second toggle joint includes:

a first joint having a first end pivotally connected to one of the group consisting of the rocking bar and the clamping bar via a sixth swivel connection, and a second end pivotally connected to the activation bar via a seventh swivel connection, the seventh swivel connection located nearer to the clamp member than the first and fifth swivel connections when the bar system is in the locked position; and a second joint comprising the portion of the activation bar that extends from the seventh swivel connection to the first swivel connection.

20. The clamping tool of claim 19, wherein the third swivel connection and the sixth swivel connection coincide.

21. The clamping tool of claim 19, wherein the sixth swivel connection is located on the rocking bar between the second swivel connection an the third swivel connection.

22. The clamping tool of claim 13, wherein the first joint of the first and second toggle joints has a substantially U-shaped cross-section.

* * * * *

UNITED STATES PATENT AND TRADEMARK OFFICE

CERTIFICATE OF CORRECTION

PATENT NO. : 6,817,603 B2
DATED : November 16, 2004
INVENTOR(S) : Kofod

It is certified that error appears in the above-identified patent and that said Letters Patent is hereby corrected as shown below:

Title Page,
Item [73], Assignee, after "Låsby", delete “(DE)” and insert -- (DK) --.

Column 6,
Line 26, after "connection which", delete “an” and insert -- in --.

Signed and Sealed this

First Day of February, 2005

JON W. DUDAS
*Director of the United States Patent and Trademark Office*